US009656153B2

(12) United States Patent
Van Horne

(10) Patent No.: US 9,656,153 B2
(45) Date of Patent: May 23, 2017

(54) SKATE BOOT WITH MONOCOQUE BODY

(71) Applicant: VH Footwear Inc., Winnipeg (CA)

(72) Inventor: Scott Van Horne, Winnipeg (CA)

(73) Assignee: VH Footwear Inc., Winnipeg, Manitoba (CA)

( * ) Notice: Subject to any disclaimer, the term of this patent is extended or adjusted under 35 U.S.C. 154(b) by 0 days.

(21) Appl. No.: 14/712,296

(22) Filed: May 14, 2015

(65) Prior Publication Data

US 2016/0332063 A1 Nov. 17, 2016

(51) Int. Cl.
*A63C 17/18* (2006.01)
*A43B 5/16* (2006.01)

(52) U.S. Cl.
CPC ..... *A63C 17/18* (2013.01); *A43B 5/16* (2013.01)

(58) Field of Classification Search
CPC .. A63C 17/18; A63C 1/00; A63C 1/30; A63C 1/26; A63C 3/00; A63C 3/02; A43B 5/16; A43B 5/1616; A43B 5/1625; A43B 5/1633; A43B 5/1641; A43B 5/1658; A43B 5/1666; A43B 5/1683; A43B 5/1691; A43B 23/26
See application file for complete search history.

(56) References Cited

U.S. PATENT DOCUMENTS 4,107,856 A * 8/1978 Bourque ..... A43B 5/0427 280/11.36
4,351,537 A * 9/1982 Seidel ..... A43B 5/1616 280/11.12
4,509,276 A * 4/1985 Bourque ..... A43B 5/1683 12/142 R
4,869,001 A * 9/1989 Brown ..... A43B 5/1683 36/115
6,371,494 B1 * 4/2002 Bonaventure ..... A43B 5/0411 280/11.19
6,499,233 B1 * 12/2002 Chenevert ..... A43B 3/26 36/10
6,550,159 B1 * 4/2003 Madore ..... A43B 7/20 280/11.18
7,140,127 B2 11/2006 Yang
7,219,900 B2 5/2007 Meibock
7,316,083 B2 * 1/2008 Labonte ..... B29D 35/146 264/154
7,325,813 B2 * 2/2008 Bock ..... A43B 5/1691 280/11.12
7,398,609 B2 * 7/2008 Labonte ..... A43B 5/1691 36/115
7,533,479 B2 * 5/2009 LaBonte ..... A43B 5/1683 36/114
7,676,959 B2 * 3/2010 Wilder ..... A43B 9/00 36/117.1

(Continued)

*Primary Examiner* — James M Dolak
(74) *Attorney, Agent, or Firm* — Ryan W. Dupius; Kyle R. Satterthwaite; Ade & Company Inc.

(57) ABSTRACT

A skate boot of the type commonly used with a lower mounting frame for supporting one of an ice skating blade or rollers thereon, has a monocoque skate boot body. The monocoque skate boot body further supports i) a toe cap of dissimilar material thereon, ii) a tendon guard of dissimilar material fastened to a rear of the monocoque skate boot body, and iii) an anchor body of dissimilar material on the sole portion of the monocoque skate boot body for assisting securement of the lower mounting frame to the monocoque skate boot body.

19 Claims, 8 Drawing Sheets

(56) References Cited

U.S. PATENT DOCUMENTS

| | | | | |
|---|---|---|---|---|
| 7,793,947 | B2 * | 9/2010 | Labonte | A43B 5/1666 280/11.12 |
| 7,950,676 | B2 * | 5/2011 | Goldsmith | A43B 5/1625 280/11.12 |
| 8,387,286 | B2 * | 3/2013 | Koyess | A43B 5/1616 12/142 R |
| 8,596,650 | B2 * | 12/2013 | Van Horne | A43B 5/1691 280/11.12 |
| 8,684,368 | B2 * | 4/2014 | Van Horne | A43B 5/1691 280/11.12 |
| 9,119,441 | B2 * | 9/2015 | Frappier | A43B 5/1675 |
| 9,266,007 | B2 * | 2/2016 | Vaughn | A63C 1/303 |
| 9,320,315 | B2 * | 4/2016 | Van Horne | A43B 5/1683 |
| 9,468,261 | B2 * | 10/2016 | Smaldone | A43B 23/26 |
| 9,510,639 | B2 * | 12/2016 | Cruikshank | A43B 5/1625 |
| 9,554,615 | B2 * | 1/2017 | Labonte | A43B 5/16 |
| 2009/0243238 | A1 * | 10/2009 | Van Horne | A43B 5/16 280/11.12 |

* cited by examiner

SKATE BOOT WITH MONOCOQUE BODY

FIELD OF THE INVENTION

The present invention relates to a skate boot of the type commonly used with a lower mounting frame for supporting one of an ice skating blade or rollers thereon, and more particularly the present invention relates to i) a monocoque skate boot body supporting a toe cap of dissimilar material thereon, ii) a tendon guard of dissimilar material fastened to a rear of the monocoque skate boot body according to a further aspect of the invention, and/or iii) an anchor body of dissimilar material on the sole portion of the monocoque skate boot body for assisting securement of the lower mounting frame to the monocoque skate boot body.

BACKGROUND

The current trend in skate boot construction is to manufacture the boot from multiple components of thermoformed and injection molded plastic. The main structure of the boot is commonly thermoformed on a compression mold that shapes a flat sheet of plastic into a 3D structure, otherwise known as lasting. The main limitation of this method is that seams are created where the thermoformed material meets and therefore require a reinforcing element to bridge the seams. As commonly seen in the prior art the resulting seam through the center of the sole needs to be reinforced with a rigid midsole and outsole. This adds weight and the potential for premature breakdown and wear through the sole of the boot. An example of this in the prior art is disclosed in U.S. Pat. No. 7,398,609.

Some alternative skate boot construction can be found in U.S. Pat. No. 7,219,900 and U.S. Pat. No. 7,140,127 where the authors disclose a support structure (or boot body as also known in the art) composed of carbon fiber and the like, which has the liner, eyelet cuff, tendon guard, and external cuff (quarter package) bonded to the already fabricated support structure. With this process it is difficult to bond the liner into the already fabricated support structure cleanly and smoothly, creating inconsistency in the final product and higher reject rates. The eyelet cuff, or quarter package (as known in the art), is not substantially integrated into the support structure and is only bonded and/or stitched to the support structure, therefore when the laces are tightened the bonded eyelet cuff bends around the support structure and does not uniformly pull the skate boot body over the instep of the wearer's foot. Also, the tendon guard is only bonded to the top of the support structure creating the potential for accelerated wear as the wearer extends their ankle and forces the tendon guard to flex back, and then forth. The toe cap is either constructed as part of the support structure, which has the following limitations: increased cost and complexity to manufacture the support structure, and accelerated wear and damage due to the nature of use and the very rigid (brittle) composition of carbon fiber composites, or the toe cap is constructed from a more durable nylon material. The limitations of using a traditional nylon toe cap are the previous means of attaching it to the support structure. A traditional nylon toe cap does not integrate well with a composite support structure as it cannot be stitched and tacked to the support structure, as it would be with a more traditional, last skate boot. Lastly, with all current boot construction methods the tongue is permanently attached to the main boot body, and the main disadvantage of this is that the position of the tongue with respect to the skate boot body cannot be adjusted to the preference of the wearer.

SUMMARY OF THE INVENTION

Embodiments of the present invention provide a skate boot for receiving a wearer's foot comprising: a monocoque skate boot body comprising a heel portion for receiving the heel of the foot; a lower toe portion for receiving the bottom and side of the toes of the foot; a sole portion for receiving an insole on the inner side, and for receiving an ice skate blade holder and the like on the outer surface, the sole portion comprising an arch section for supporting the medial longitudinal arch of the foot; an ankle portion for receiving the wearer's ankles; a lower Achilles tendon portion for receiving the base of the wearer's Achilles tendon, the lower Achilles tendon portion is located directly above the heel portion; an upper Achilles tendon portion for receiving a tendon guard; an eyelet cuff portion for receiving the top of the foot, the eyelet cuff portion houses the eyelet holes, through which eyelets are installed, through which a lace is utilized to tighten the skate boot to the wearer's foot.

Also included, an integrated liner portion comprised of foam for cushioning the wearer's foot, bonded to a material layer for providing comfort against the wearer's skin, an outer material bonded and stitched to the outer surface of the monocoque skate boot body, and a toe cap constructed from nylon, a tendon guard secured to the upper Achilles tendon portion, and a tongue attached to the toe box portion.

The main objectives of the present invention is to provide a skate boot which is more comfortable, more supportive, provides for customization of the tongue and tendon to the wearer's preference, has superior protection and durability, and incorporated a fabrication process that is more efficient and that reduces the rejection rate.

Detailed explanation and further objectives, and novel features of the invention are presented in the following detailed description when taken in conjunction with the accompanying drawings.

According to a first aspect of the invention there is provided a skate boot for receiving a foot of a user, the skate boot comprising:

(a) a monocoque skate boot body comprising i) a sole portion extending longitudinally between a toe end and a heel end for supporting the foot of the user thereon, ii) an inner side wall portion and an outer side wall portion oriented generally longitudinally and extending upwardly from laterally opposing sides of the sole portion at an intermediate location between the toe end and the heel end towards respective upper free edges which are laterally spaced apart so as to define a tongue opening therebetween, iii) two ankle portions extending upwardly from said laterally opposing sides of the sole portion at the heel end in connection with respective ones of the side wall portions for spanning over respective ankles of the foot of the user, and iv) a heel portion extending upwardly from the heel end of the sole portion in connection between the two ankle portions, wherein the sole portion, the side wall portions, the two ankle portions, and the heel portion are integrally formed of at least one common material;

(b) a toe cap joined to monocoque skate boot body proximate the toe end thereof, the toe cap being formed of a material which is dissimilar to the common material of the monocoque skate boot body, the toe cap comprising i) an upright end wall supported to extend upwardly from the toe end of the sole portion, ii) two side walls supported to extend upwardly from said laterally opposing sides of the sole portion respectively, and iii) an upper portion joined between the end wall and the side walls at a location spaced above the toe end of the sole portion so as to define a toe box between the upper portion of the toe cap and the toe end of the sole portion for receiving toes of the foot of the user therein; and (c) a tongue supported to span the tongue opening between the upper free edges of the side wall portions.

Preferably the monocoque skate boot body further comprises a lower toe portion extending upwardly from the toe end of the sole portion to an upper edge which is overlapped at an outer side by at least one of the end wall and the two side walls of the toe cap.

The toe cap preferably includes a lower flange portion extending inwardly from a bottom end of at least one of the end wall and the two side walls of the toe cap in overlapping configuration along a bottom side of the toe end of the sole portion. The lower flange portion may extend inwardly from each of the end wall and the two side walls in a generally U-shaped configuration. When provided in combination with a lower mounting frame for mounting one of a blade or rollers below the sole portion, preferably the lower mounting frame is in fastened connection to the sole portion using at least one mechanical fastener extending through the lower flange portion of the toe cap.

When the inner and outer side wall portions of the boot body terminate at respective upright forward edges which are spaced inwardly from the toe end of the sole portion, preferably the side walls of the toe cap overlap an outer side of the inner and outer side wall portions proximate respective rear edges thereof.

Preferably at least one side wall of the toe cap includes at least one eyelet opening therein which receives an eyelet which mechanically fastens the eyelet opening to a corresponding opening in the respective side wall portion of the boot body in alignment therewith.

Preferably the tongue is joined to the upper portion of the toe cap. The tongue may be longitudinally adjustable relative to the toe cap.

In the illustrated embodiment, the side walls of the toe cap each comprises a rear edge and a stepped flange along the rear edge in which the side wall is reduced in thickness relative to a remainder of the side wall. When the skate boot further comprises an outer panel bonded to an outer side of each side wall portion of the boot body, preferably a forward edge portion of the outer panel is in overlapping configuration with a respective one of the stepped flanges of the side walls of the toe cap to which the forward edge portion is joined by stitching.

Preferably the material of the toe cap is more resilient than the common material of the boot body.

When the monocoque skate boot body further comprises v) a lower Achilles tendon portion above the heel portion for receiving a base of an Achilles tendon of the foot of the user, and vi) an upper Achilles tendon portion above the lower Achilles tendon portion comprising an upright supporting flange, preferably the skate boot further comprises a tendon guard including a lower mounting portion for mounting on the upright supporting flange of the upper Achilles tendon portion of the skate boot body and an upper guard portion extending upwardly above the lower mounting portion. Preferably the lower mounting portion includes an inner mounting flange for extending downwardly along an inner surface of the upright supporting flange of the upper Achilles tendon portion and an outer mounting flange spaced apart from the inner mounting flange for receiving the upper supporting flange of the upper Achilles tendon portion therein such that the outer mounting flange extends downwardly along an outer surface of the upright supporting flange of the upper Achilles tendon portion.

When the skate boot is provided in combination with a lower mounting frame for mounting one of a blade or rollers below the sole portion in fastened connection to the sole portion using a plurality of mechanical fasteners, the skate boot preferably further comprises an anchor body supported on the sole portion such that at least a lower portion of the sole portion of the skate boot body is clamped between the anchor body and the lower mounting frame by at least some of the plurality of mechanical fasteners extending through said lower portion of the sole portion in which the anchor body is formed of a material which is dissimilar to the skate boot body.

According to a second aspect of the present invention there is provided a skate boot for receiving a foot of a user, the skate boot comprising:

a sole portion extending longitudinally between a toe end and a heel end for supporting the foot of the user thereon;

two ankle portions extending upwardly from laterally opposing sides of the sole portion for spanning over respective ankles of the foot of the user;

a heel portion extending upwardly from the heel end of the sole portion in connection between the two ankle portions for receiving a heel of the user;

a lower Achilles tendon portion above the heel portion for receiving a base of an Achilles tendon of the foot of the user;

an upper Achilles tendon portion above the lower Achilles tendon portion comprising an upright supporting flange; and a tendon guard comprising:

a lower mounting portion for mounting on the upright supporting flange of the upper Achilles tendon portion of the skate boot body; and an upper guard portion extending upwardly above the lower mounting portion;

the lower mounting portion including an inner mounting flange for extending downwardly along an inner surface of the upright supporting flange of the upper Achilles tendon portion and an outer mounting flange spaced apart from the inner mounting flange for receiving the upright supporting flange of the upper Achilles tendon portion therein such that the outer mounting flange extends downwardly along an outer surface of the upright supporting flange of the upper Achilles tendon portion.

When there is provided a liner member spanning an inner side of the heel portion, preferably a bottom edge of the inner mounting flange of the tendon guard abuts an upper edge of the liner member and a thickness of the inner mounting flange of the tendon guard proximate the bottom edge thereof is less than a thickness of the liner member proximate the upper edge thereof.

Preferably a joining fastener extends collectively through the inner mounting flange of the tendon guard, the outer mounting flange of the tendon guard, and the upright supporting flange of the upper Achilles tendon portion of the skate boot.

Preferably the upper guard portion is wider than the lower mounting portion.

Preferably the upright supporting flange of the upper Achilles tendon portion terminates at an upper edge which is recessed in height relative to the two ankle portions of the skate boot.

According to a third aspect of the present invention there is provided a skate boot for receiving a foot of a user in combination with a lower mounting frame for mounting one of a blade or rollers below the sole portion in fastened connection to the sole portion using a plurality of mechanical fasteners, the skate boot comprising:

a monocoque skate boot body comprising i) a sole portion extending longitudinally between a toe end and a heel end for supporting the foot of the user thereon, ii) two ankle portions extending upwardly from laterally opposing sides of the sole portion for spanning over respective ankles of the foot of the user, and iii) a heel portion extending upwardly from the heel end of the sole portion in connection between the two ankle portions, wherein the sole portion, the two ankle portions, and the heel portion are integrally formed of at least one common material; and an anchor body supported on the sole portion such that at least a lower portion of the sole portion of the monocoque skate boot body is clamped between the anchor body and the lower mounting frame by at least some of the plurality of mechanical fasteners extending through said lower portion of the sole portion;

the anchor body being formed of a material which is dissimilar to the skate boot body.

When the skate boot further comprises a toe cap joined to monocoque skate boot body proximate the toe end thereof, the toe cap preferably includes a lower flange portion in overlapping configuration along a bottom side of the toe end of the sole portion such that some of the mechanical fasteners of the lower mounting frame extend through the lower flange portion of the toe cap.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
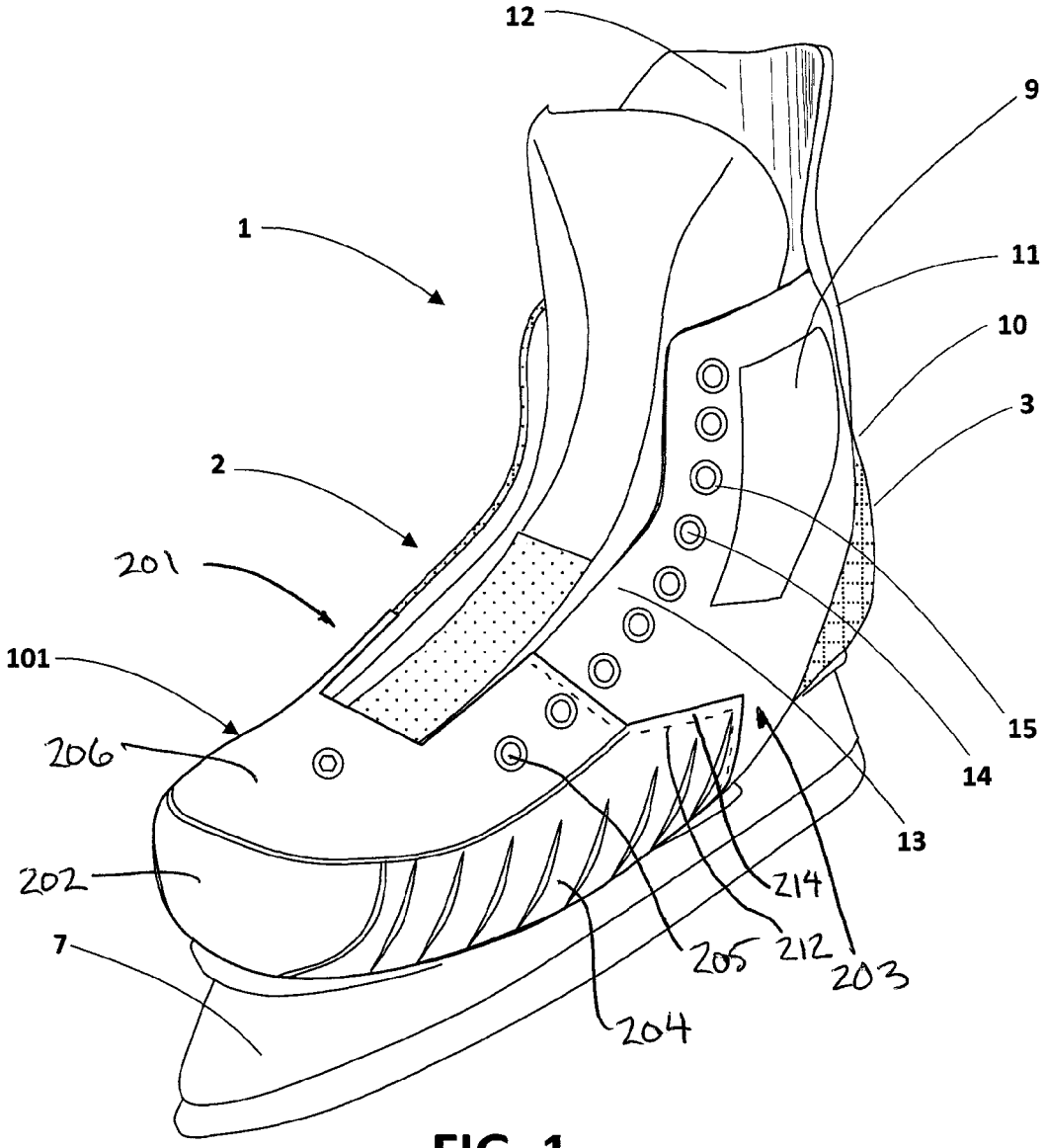
FIG. 1 is a perspective view of a skate boot in accordance with the present invention, with an attached skate blade and holder.

FIG. 1 is a perspective view of a skate utilizing the preferred embodiments of the present invention, including a skate boot 1 for receiving a wearer's foot comprising: a monocoque skate boot body 2 comprising a heel portion 3 for receiving the heel of the foot, which is located between the base of the skate and the approximate location of a wearer's proximal calcaneal bone surface; a lower toe portion 4 for receiving the bottom and side of the toes of the foot (displayed in FIG. 2), which is extends up to between the middle and top of the approximate location of a wearer's toes; a sole portion 5 for receiving an insole 6 (displayed in FIG. 2) on the inner side, and for receiving an ice skate blade holder 7, and the like, on the outer surface, said sole portion comprising an arch section 8 (displayed in FIG. 4) for supporting the medial longitudinal arch of a wearer's foot; an ankle portion 9 for receiving the wearer's ankle; a lower Achilles tendon portion 10 for receiving the base of the wearer's Achilles tendon, the lower Achilles tendon portion 10 is located directly above the heel portion 3, and extends up to the approximate height of a wearer's lateral ankle bone; an upper Achilles tendon portion 11 for receiving a tendon guard 12, with the upper Achilles tendon portion 11 located between the top of the lower Achilles tendon portion 10 and the top posterior edge of the monocoque skate boot body 2; an eyelet cuff portion 13 for receiving the top of the foot, which is located between the eyelet cuff edge 43 and approximately 4 cm distally into the monocoque skate boot body 2, the eyelet cuff portion 13 houses the eyelet holes 14, through which eyelets 15 are installed, through which a lace is utilized to tighten the skate boot to the wearer's foot (lace not shown); a toe cap 101 constructed of a dissimilar material to that of the monocoque skate boot body. The advantage of having the eyelet cuff portion 13 integrated and part of the monocoque skate boot body 2 is: as the laces are tightened the entire boot wraps consistently, and more evenly, over the instep of the wearer's foot, creating a more secure, more effective fastening, which is more comfortable and more supportive.

Figure 2:
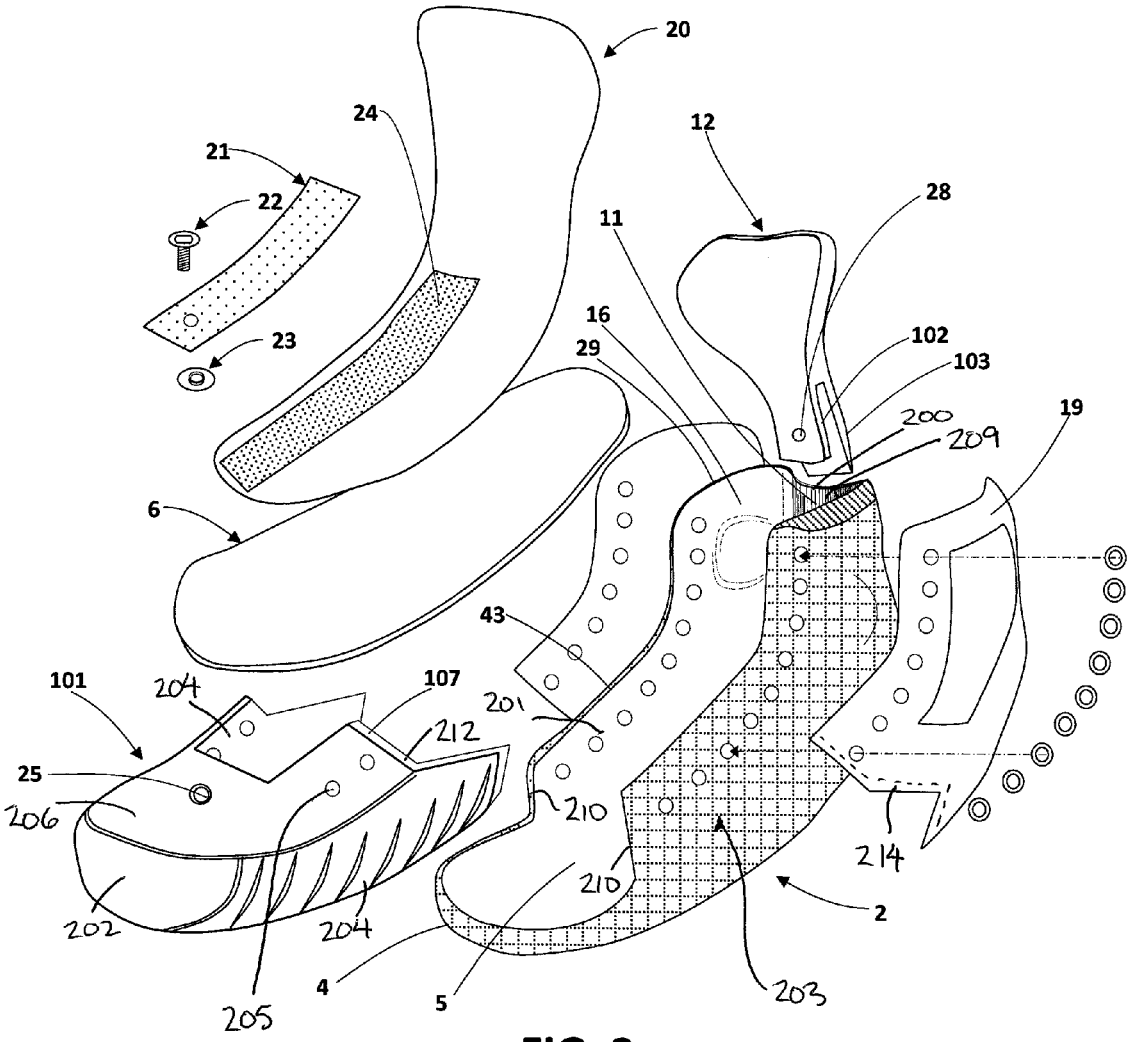
FIG. 2 is an exploded view of the skate boot of FIG. 1.
Figure 6:
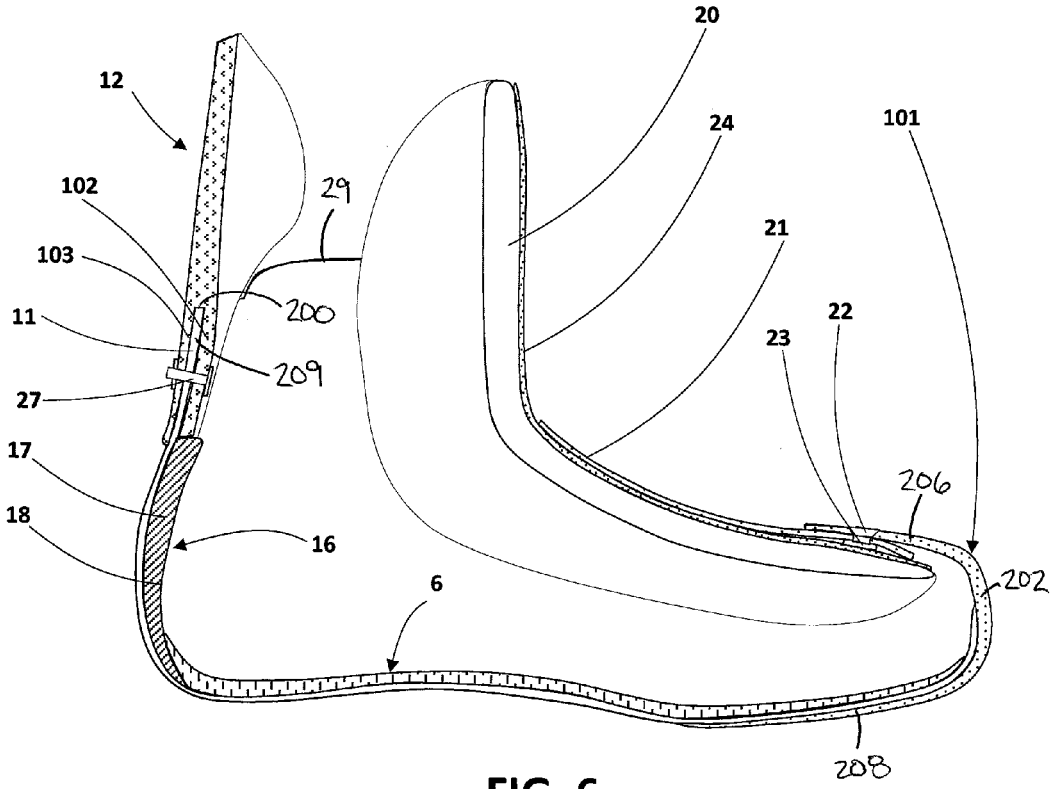
FIG. 6 is a cross sectional view of the monocoque skate boot body, with the tongue, tendon guard, and toe cap installed, in accordance with the present invention, with the sectional view along the line "5-5" in FIG. 3.

As displayed in FIG. 2 and FIG. 6 an integrated liner portion 16 is included and comprised of foam 17 for cushioning the wearer's foot bonded to a material layer 18 for providing comfort against the wearer's skin. An outer material 19 is bonded and stitched to the outer surface of the monocoque skate boot body 2, and the liner portion 16, along the eyelet cuff edge 43 and the top edge 29 on the medial and lateral sides. Plus, the outer material 19 is stitched to the stitching flange 107 of the toe cap 101. A tongue 20 is attached to the toe cap 101.

FIG. 2 is an exploded view of the skate boot 1 wherein the tongue 20 is shown to be removably attached to the monocoque skate boot body 2 with a hook and loop fastening strip 21. In the current embodiment the hook strip is shown to be the fastening strip 21 and the loop strip 24 is shown to be sewn to the top surface of the tongue 20, but this arrangement is interchangeable. The fastening strip 21 is attached to the underside of the top of the toe cap portion 101 via a t-nut 23, and on top, a bolt 22 through the hole 25, but could alternatively be attached through rivets, adhesives, and the like. This arrangement is also clearly shown in FIG. 6. When the hook strip, fastening strip 21 engages the loop strip 24 the tongue 20 is mechanically held in place. The advantage of this embodiment is that the position of the tongue 20 can be modified and customized to the wearer's preference. Therefore, the position of the tongue 20 can be shifted in a proximal direction to the wear's instep for increased lower leg support, or alternatively it can be shifted in a distal direction to the wearer's instep for increased forward flexion (dorsi flexion) of the ankle joint. To shift the tongue 20 the wearer simply needs to lift the fastening strip 21 from the loop strip 24, reposition the tongue 20, and then press the fastening strip 21 back down.

FIG. 2 also shows the tendon guard 12. In the preferred embodiment the tendon guard 12 is a single injection molded piece of plastic, with the material comprised of toughening additives to provide a component that is resilient, flexible, and durable. The lower portion of tendon guard 12 forms two prongs, comprising an inner prong 102, and an outer prong 103. For installation onto the monocoque skate boot body 2, tendon guard 12 is slide onto the upper Achilles tendon portion 11 with the inner prong 102 resting in a preformed recess, which is both unique and novel, on the superficial side of the upper Achilles tendon portion 11, and the outer prong 103 resting on the outside of the upper Achilles tendon portion 11. In a preferred embodiment the tendon guard 12 is attached to the upper Achilles tendon portion 11 by a rivet 27 (displayed FIG. 6), through the hole 28, but in alternate embodiments the tendon guard 12 could also be attached via bolts, contact adhesive, thermoset adhesives, and the like.

Figure 3:
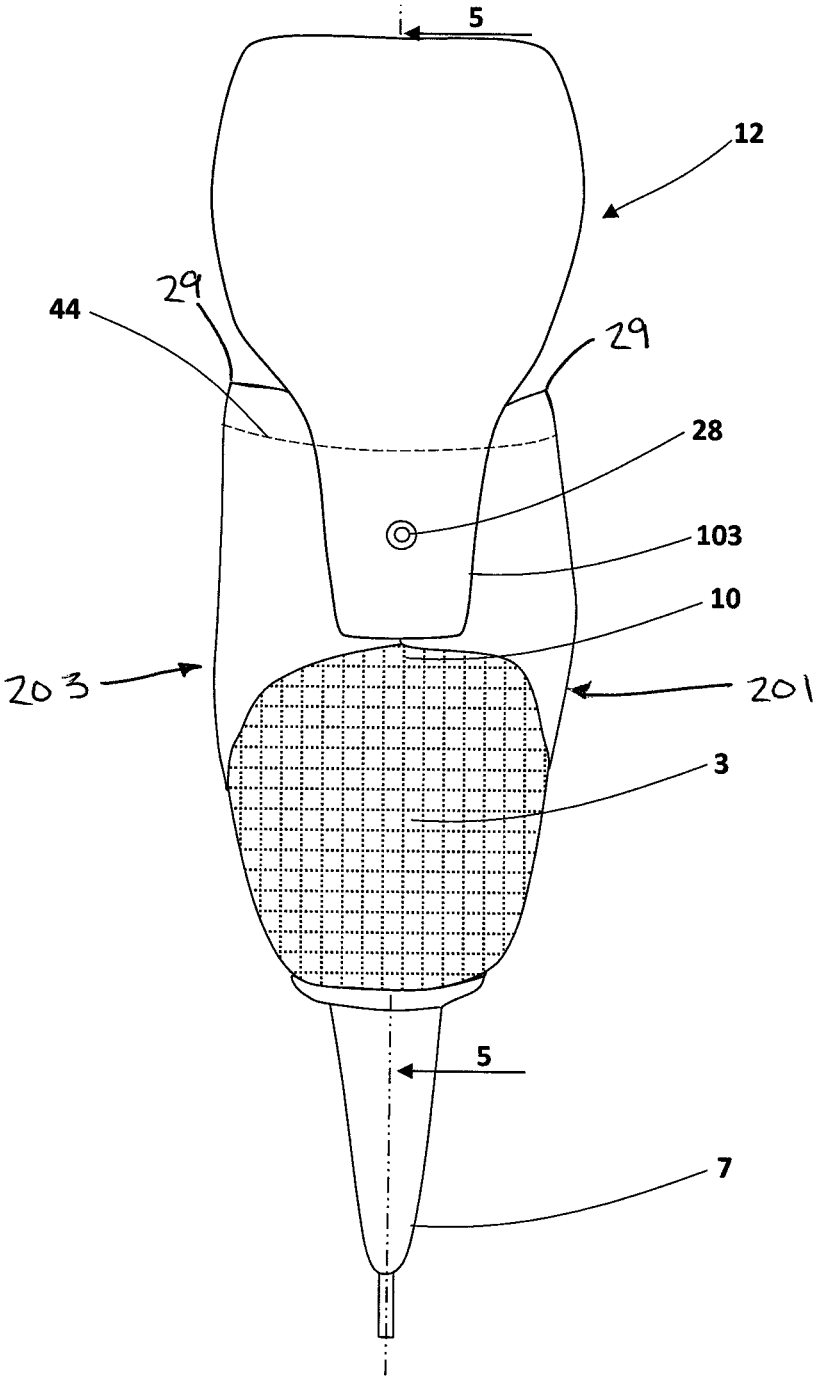
FIG. 3 is a rear elevation view of a skate boot in accordance with the present invention, with an attached skate blade and holder.

FIG. 3 Is a rear elevation view of the skate boot 1 with a blade and holder 7 attached. The top of the ankle portion 9 is represented by a dashed line 44.

Figure 4:
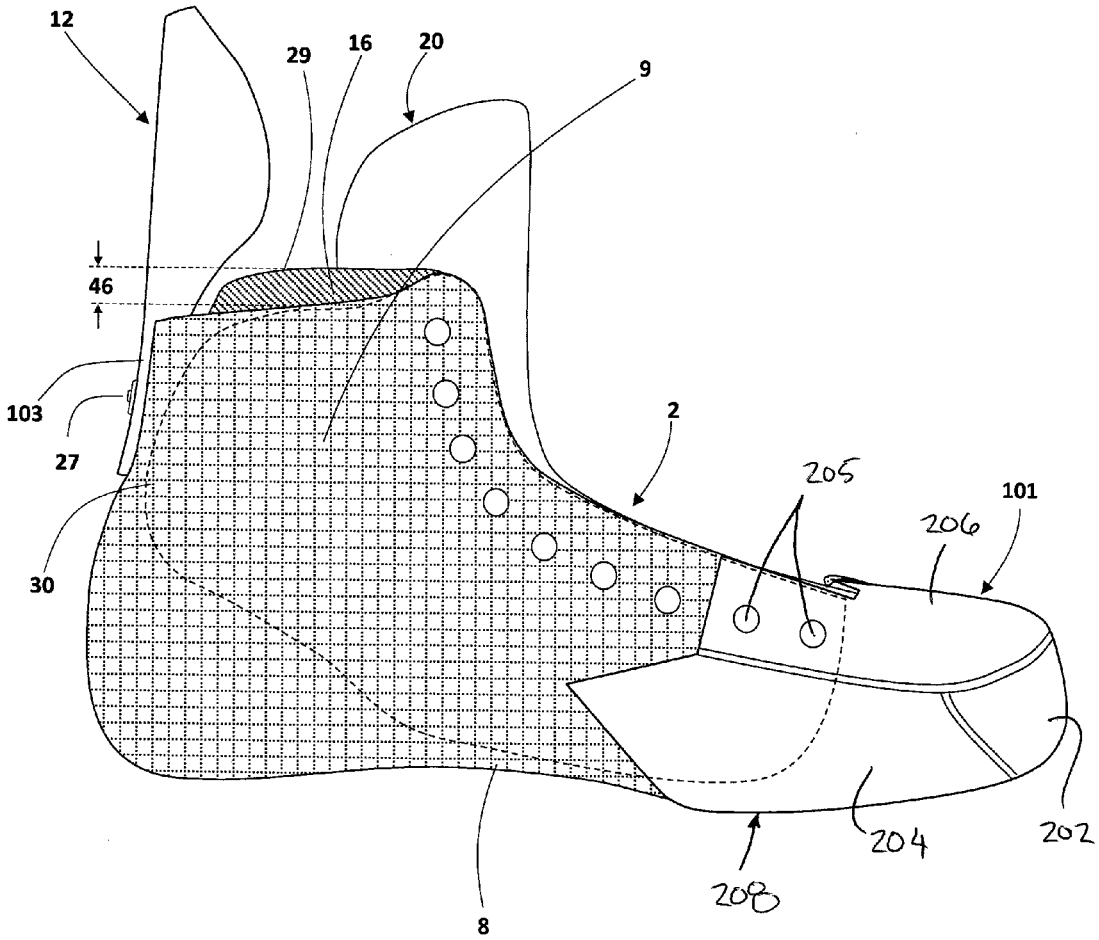
FIG. 4 is a side elevation view of the monocoque skate boot body, with the tongue, tendon guard, and toe cap installed, in accordance with the present invention.

FIG. 4 shows a side elevation view of the monocoque skate boot body 2 with the tongue 20 and tendon guard 12 installed. In a preferred embodiment of the current invention the top of the ankle portion 9 extends above the wearer's ankle to a point of no less than an optimal distance 46 of 5 mm below the top edge 29 of the medial and lateral sides, with the liner portion 16 and the outer material 19 extending to the top edge 29. Most other skate boots have a rigid material extending above the wearer's ankle all the way to the top edge, which while aggressive edging, when the ankle joint is in an inverted or everted position, digs into the wearer's leg. The advantage of this preferred embodiment is that the top 5 mm of soft liner portion 16 and flexible outer material 19 cushions the wearer's leg during aggressive edging, and protects against the top edge of the monocoque skate boot body 2, located 5 mm lower, from digging into their leg.

The monocoque skate boot body 2 is comprised of carbon fiber, aramid fiber, glass fiber, and the like, impregnated with a liquid resin that when activated cures to form a rigid composite structure matrix. The monocoque skate boot body 2 has strategically placed thermo-formable plastic regions 30 (represented with a dotted line in FIG. 4) integrated into the rigid composite structure matrix, but not limited to the area shown. The thermo-formable plastic regions 30 are located in the present embodiment, but not limited to, the region of the lateral/medial ankle bones to provide for comfortable reshaping to the wearer's ankle bones, and within the eyelet cuff portion to provide more flexibility for greater ease when the wearer puts the skate boot 1 on and off. The thermo-formable plastic regions 30 can be softened at temperatures below 80° C. so that the wearer can heat mold the skate boot 1 directly to their foot, creating a custom fit when cooled. The wearer can follow a general heat molding process, which involves baking the skate in a conventional oven for 20 minutes at 82° C. The low melting temperature of the thermo-formable plastic also allows for greater ease of positioning and shaping of such material during the fabrication of the monocoque skate boot body 2.

Figure 5:
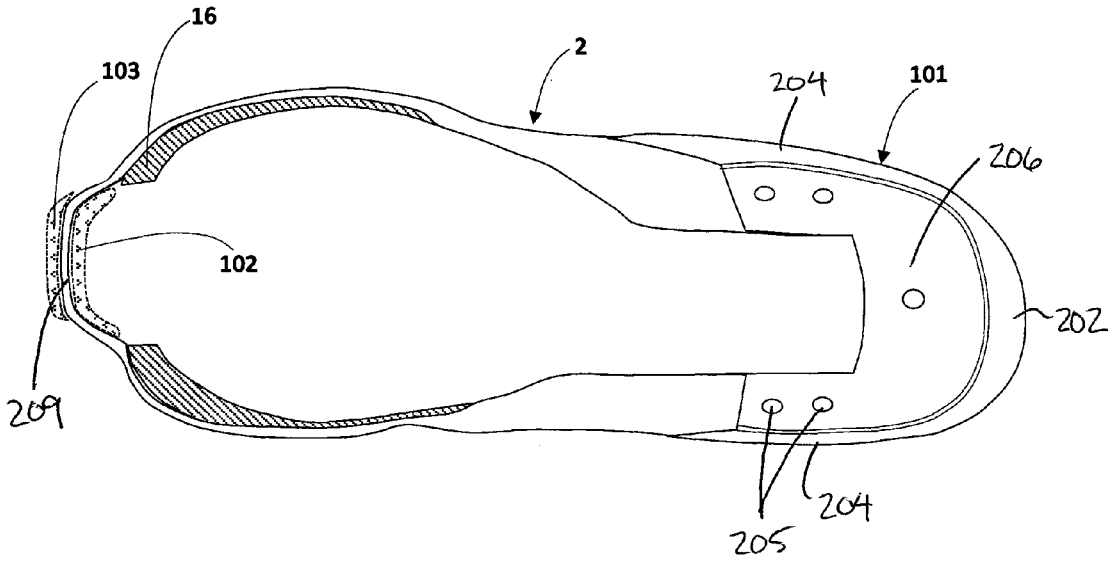
FIG. 5 is a top elevation view of the monocoque skate boot body, with the toe cap installed, and the tendon guard sectioned along the top of the skate boot and positionally shown with a dotted line, in accordance with the present invention.

FIG. 5 is a top elevation view of the monocoque skate boot body 2, with the toe cap 101 installed, and the tendon guard 12 sectioned along the top of the upper Achilles tendon portion 11 and positionally shown with a dotted line, in accordance with the present invention. The installed position of inner prong 102, and an outer prong 103 can be clearly seen.

FIG. 6 shows a cross sectional view of the monocoque skate boot body 2 with the tendon guard 12 and tongue 20 attached. In this drawing many elements can be seen: The fastening strip 21 attached to the underside of the toe cap portion 101 via a t-nut 23 and bolt 22, the insole 6 for receiving the sole of the wearer's foot, the liner portion 16 that is comprised of foam 17 for cushioning the wearer's foot, bonded to a material layer 18 for providing comfort against the wearer's skin.

Figure 7:
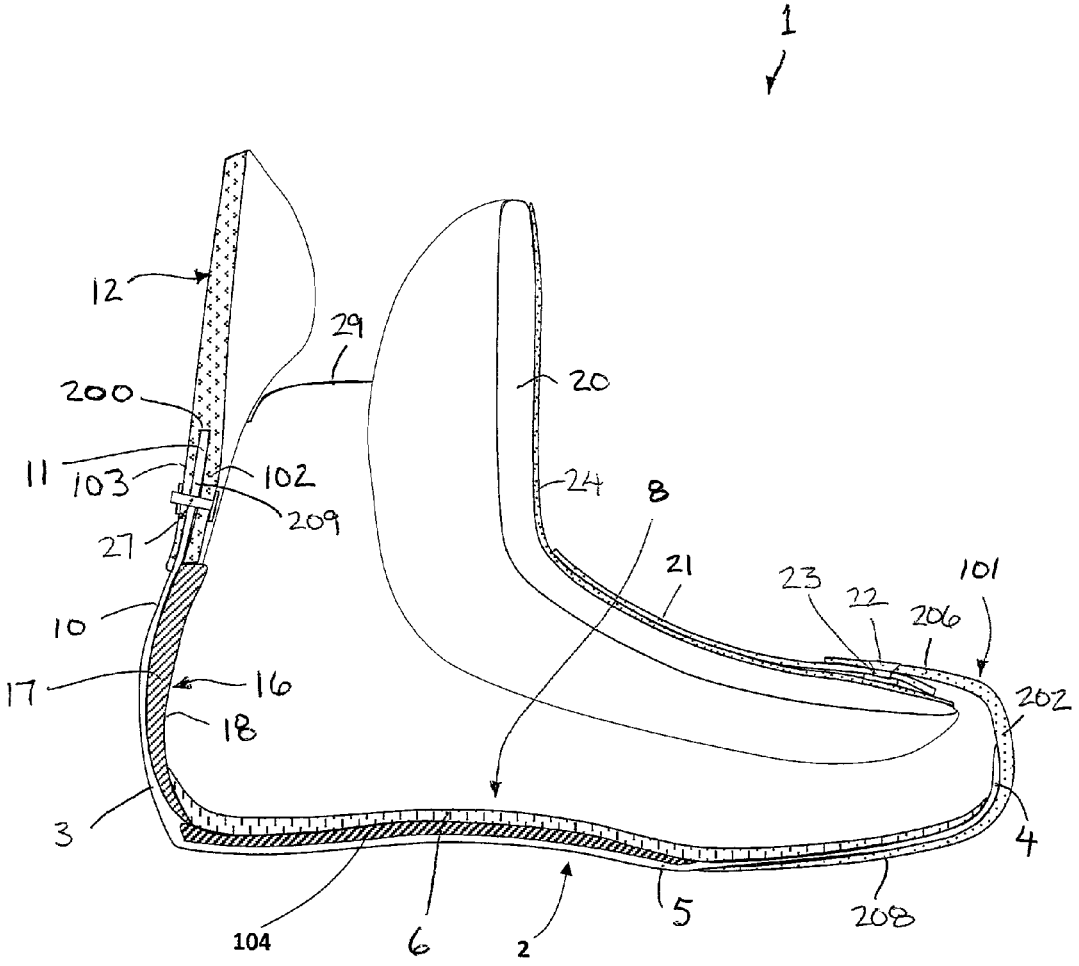
FIG. 7 is a cross sectional view of the monocoque skate boot body, with the tongue, tendon guard, and toe cap installed, in accordance with and alternate embodiment of the present invention, with the sectional view along the line "5-5" in FIG. 3.

FIG. 7 is a cross sectional view of the monocoque skate boot body 2, displaying an alternate embodiment of the present invention. An integrated molded piece 104 defining an anchor body is positioned superficially to the monocoque skate boot body 2, and therefore more proximal to the wearer's foot, the integrated molded piece 104 has the function of receiving the crimp end of a rivet for fastening the blade holder or inline chassis to the skate boot. Carbon fiber composites are very rigid and therefore create premature loosening of the rivets. By incorporating the integrated molded piece 104, which in the current embodiment is comprised of a plastic type material, the issue of premature loosening of the rivets is eliminated, by providing for a softer material for the rivet crimp ends to bite into, while still retaining the benefits of a carbon composite skate boot body: light weight, better power transfer to the ice, and more protective. The integrated molded piece 104 is injection molded or die cut from a plastic type material.

Figure 8:
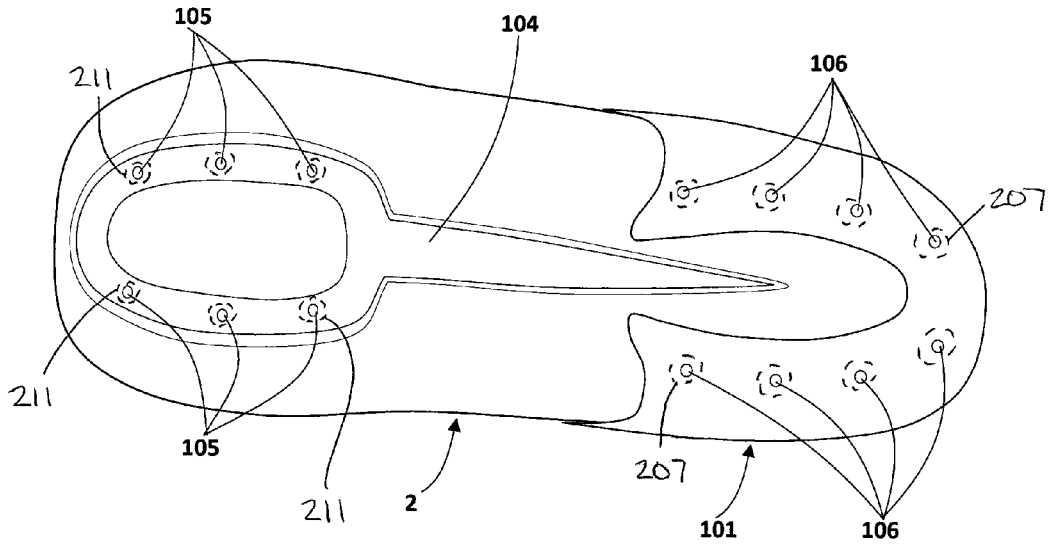
FIG. 8 is a bottom elevation view of the monocoque skate boot body, with the toe cap installed, in accordance with an alternate embodiment of the present invention.

FIG. 8 is a bottom elevation view of the monocoque skate boot body 2, with the toe cap 101 installed, in accordance with the alternate embodiment of the present invention described in the paragraph immediately above. The shape of the integrated molded piece 104 can be seen through the base of the monocoque skate boot body 2, which is formed through a wet lay-up process, wherein resin wetted composite (woven fiber material composed of carbon fiber, aramid fiber, glass fiber, and the like, which have been impregnated with activated resin) is laid over the foot form and then vacuum bagged and warmed until cured, resulting in a rigid composite structure matrix. The integrated molded piece 104 is shaped to receive the rear pedestal of the blade holder 7, wherein all rear mounting holes 105 are contained. The toe cap 101 can be seen to provide a shape to receive the front pedestal of the blade holder 7, wherein all front mounting holes 106 are contained. When the blade holder 7 is installed the toe cap 101 is mechanically held to the monocoque skate boot body 2 in a novel fashion, through the use of rivets, bolts and the like, this along with installing the bottom 2 eyelets 15 through the monocoque skate boot body 2 and the toe cap 101 provide for effective and novel fastening of the toe cap 101 to the monocoque skate boot body 2. The reason for the importance of the aforementioned mentioned mechanical fastening is because nylon plastic, which the toe cap 101 is comprised of, cannot be effectively bonded to the monocoque skate boot body 2, therefore necessitating some form of mechanical attachment.

The main advantages of the one piece monocoque skate boot body 2 as compared to prior art may include increased strength and stiffness, reduced weight, more response during skating, better and more direct power transfer during the skating push phase, increased manufacturing efficiency, and/or reduced reject rate.

As described above, the skate boot according to the present invention generally includes the skate boot body 2 as a single unitary structure to which is attached a toe cap 101, a lower mounting frame 7 (described above as a blade holder), and a tendon guard 12.

The boot body 2 generally includes a sole portion which extends longitudinally between a toe end and an opposing heel end to form the portion of the boot body upon which the bottom of the foot of the user is supported along the length thereof.

The boot body further includes an inner side wall portion 201 and an outer side wall portion 203 described above as an eyelet cuff 13 in which the side wall portions are generally oriented in the longitudinal direction to extend upwardly from laterally opposing sides of the sole portion at an intermediate location between the toe end and the heel end. The forward ends of the inner and outer side wall portions terminate at respective upright forward edges 210 which extend upwardly from the sole portion at a location spaced rearwardly from the toe end of the sole portion to accommodate the lower toe portion 4 forwardly therefrom. The inner and outer side wall portions extend upwardly to respective upper free edges 43 which are generally longitudinally oriented and which are laterally spaced apart from one another to define a tongue opening therebetween.

The boot body further includes two ankle portions 9 which also extend upwardly from laterally opposing sides of the sole portion in proximity to the heel end thereof so as to be continuous and in connection with respective ones of the side wall portions 13 forwardly thereof. The two ankle portions extend upwardly to respective top edges 29 which are spaced above the height of the side wall portions terminating at the top edges 43 such that the two ankle portions are suited for spanning over respective ankles of the foot of the user.

The heel portion 3 extends upwardly from the heel end of the sole portion in a generally U-shaped arrangement in connection between the two ankle portions 9. The heel portion has a generally concave interior shape for conforming to the heel of the foot of the user received therein.

A lower Achilles tendon portion 10 extends upwardly from the heel portion so as to be similarly connected between the two ankle portions 9. The lower Achilles tendon portion 10 extends upwardly at a slight forward slope relative to the heel portion therebelow while also becoming narrower in width to follow the shape of the base of the tendon area of the foot of the user.

The upper Achilles tendon portion 11 extends upwardly from the lower Achilles tendon portion 10 also connected between the two ankle portions. The upper Achilles tendon portion generally comprises an upright supporting flange 209 having a base which is approximate the upper edge of the liner 16 at the heel end of the boot body, to extend upwardly therefrom at a slight longitudinally forward slope towards an upper edge 200 which is recessed in height relative to the top edges 29 of the ankle portions 9 respectively. The upright supporting flange 209 is received within a slot defined between the inner prong (or inner mounting flange) 102 and the outer prong (or outer mounting flange) 103 in the mounted position of the tendon guard 12 upon the upper Achilles tendon portion 11.

The boot body 2 also includes the lower toe portion 4 in the form of an upright flange terminating at a top edge which is spaced slightly above the sole portion in a generally U-shaped arrangement about the toe end of the sole portion. The top end of the upright flange forming the lower toe portion 4 extends up to only half a height of the toe box defined by the toe cap receiving the toes of the user therein so as to be spaced below an upper wall portion of the toe cap which defines the upper boundary of the toe box receiving the toes of the user therein such that the toe box is covered from above by the toe cap but remains uncovered from above by the monocoque skate boot body as shown in FIGS. 2 and 6.

The toe cap 101 comprises a second unitary body of material different from the material of the boot body, and is joined to the toe end of the sole portion of the boot body. The toe cap 101 generally includes an upright end wall 202 which overlaps an outer side of the lower toe portion at the outermost toe end of the boot body to extend upwardly from the sole portion to a height which is greater than the height of the lower toe portion 4. The toe cap further includes two side walls 204 extending upwardly from laterally opposing sides of the sole portion at the toe end thereof in a generally U-shaped configuration with the end wall, similarly overlapping respective portions of the lower toe portion 4 of the boot body. An upper portion 206 of the toe cap, which forms the upper boundary, spans laterally between the two opposed side walls and is joined to the top end of the end wall to fully enclose the top end of the toe box area defined by the toe cap. The upper portion of the toe cap is spaced above the toe end of the sole portion to define the internal height of the toe box area therebetween.

The toe cap 101 further includes a lower flange portion 208 extending generally horizontally or laterally inwardly from the bottom end of each of the two side walls and the end wall of the toe cap in an overlapping configuration below the bottom side of the sole portion at the toe end thereof in a generally U-shaped configuration. The blade holder, or lower mounting frame 7, which mounts an ice skate blade or in-line skate rollers thereon for example, is fastened to the boot body at the forward end thereof by forward fasteners 207 which are fastened through the lower flange portion of the toe cap at the toe end of the boot body.

The two side walls of the toe cap extend rearwardly beyond the upright forward edges of the two side walls of the boot body such that a portion of the side walls of the toe cap overlaps longitudinally along the outer side of the forward portions of the two side walls portions 13 of the boot body. The side walls of the toe cap thus overlap two forwardmost ones of the eyelet holes 14 in each of the side wall portions 13 of the boot body so that corresponding eyelet openings 205 in the side walls of the toe cap align with the respective ones of the eyelet openings in the side wall portions. This permits the eyelet fasteners 15 received therethrough to form a mechanically fastened connection at each of the overlapping eyelet opening locations.

The rear edge of each of the two side walls of the toe cap is spaced rearwardly from the upright forward edges 210 of the side wall portions 13 of the boot body and are generally upright in orientation. Each rear edge 212 of the side walls of the toe cap is further provided with a stepped flange 107 where the side wall thickness is reduced relative to a remainder of the side wall of the toe cap so as to be stepped inwardly towards the interior of the skate body boot relative to the remainder of the toe cap. The two outer layers 19 are provided as outer panels bonded to the outer sides of the side wall portions 13 and ankle portions 9 of the boot body such that the forward portions 214 thereof overlap over the exterior of the stepped flange 107 of the toe cap. Suitable stitching is provided to further join the forward edges of the outer panels 19 to the respective flanges 107 at each side of the boot body.

The upper portion of the toe cap includes a slotted opening along the rear edge thereof at a laterally central location between the two side walls for alignment with the tongue opening between the top edges 43 of the side wall portions 13 of the boot body. The fastener hole 25 for securing of the tongue 20 to the toe cap is provided in the upper portion of the toe cap body at a location forwardly of the slotted opening in the rear edge thereof.

The tendon guard 12 also comprises a single unitary body formed separately from the boot body and the toe cap for subsequent connection thereto as described herein. The tendon guard 12 generally includes a lower mounting portion defined by the inner prong 102 (also referred to herein as the inner mounting flange) and the outer prong 103 (also referred to herein as the outer mounting flange). The tendon guard further includes an upper guard portion defined as the remainder of the body of the tendon guard extending upwardly above the lower mounting portion defined by the inner and outer prongs.

The inner mounting flange 102 and the outer mounting flange 103 are generally planar flanges which are substantially parallel and spaced apart from one another by the thickness of the upright supporting flange of the upper Achilles tendon portion 11 to permit the upright supporting flange of the boot body to be received therein in a mounted configuration. The inner and outer mounting flanges are narrower in width than the upper guard portion as the upper guard portion of the tendon guard diverges laterally outwardly in width at both side edges relative to corresponding side edges of the inner and outer mounting flanges of the lower mounting portion therebelow. The lower mounting portion is thus suited to be received overtop, of the upright supporting flange of the upper Achilles tendon portion 11 of the skate boot body. The upright supporting flange is recessed rearwardly relative to a remaining portion of the boot body surrounding the upright supporting flange by at least a thickness of the inner mounting flange. In this manner, an inner surface of the inner mounting flange in the mounted position is substantially flush with or is recessed rearwardly in relation to adjacent portions of the upper Achilles portion and ankle portions 9 of the surrounding boot body.

The bottom edge of the inner mounting flange of the tendon guard abuts the top edge of the liner material 16 at the heel portion and lower Achilles tendon portion 10 of the boot body. The thickness of the inner mounting flange at the bottom edge thereof is thinner than the thickness of the upper edge of the liner 16 such that the inner surface of the tendon guard is recessed rearwardly relative to the inner surface of the finer 16 along an inner surface at the rear of the skate boot.

A single fastener 27 is used for extending commonly through each of the inner mounting flange, the upright supporting flange, and the outer mounting flange.

According to the embodiment of FIG. 7, the skate boot body further includes an anchor body 104 which is incorporated along an inner side of the sole portion at the heel end thereof, so as to extend only partway along a length of the sole portion from the heel end towards the toe end thereof. The anchor body is formed as a unitary body of a material having a greater tensile strength than the material of the unitary boot body. By being received at an interior surface of the sole portion at the heel end thereof, a lower portion of the sole portion 5 towards the heel end thereof overlaps the outer side of the anchor body 104 such that when the lower mounting frame 7 is mounted to the bottom side of the sole portion of the boot body, a portion of the sole portion at the heel end is effectively clamped between the rear portion of the lower mounting frame and the anchor body 104. Rear ones of the mounting fasteners 211 for securing the lower mounting frame to the boot body extend through the sole portion to be anchored between the anchor body 104 and the mounting frame in a mounted position.

Since various modifications can be made in my invention as herein above described, it is intended that all matter contained in the accompanying specification shall be interpreted as illustrative only and not in a limiting sense.

The invention claimed is:

1. A skate boot for receiving a foot of a user, the skate boot comprising:

(a) a monocoque skate boot body comprising: (i) a sole portion extending longitudinally between a toe end and a heel end for supporting the foot of the user thereon along a bottom of the skate boot body, (ii) an inner side wall portion and an outer side wall portion oriented generally longitudinally and extending upwardly from laterally opposing sides of the sole portion at an intermediate location between the toe end and the heel end towards respective upper free edges which are laterally spaced apart so as to define a tongue opening therebetween, (iii) two ankle portions extending upwardly from said laterally opposing sides of the sole portion at the heel end in connection with respective ones of the side wall portions for spanning over respective ankles of the foot of the user, and (iv) a heel portion extending upwardly from the heel end of the sole portion in connection between the two ankle portions, wherein the sole portion, the side wall portions, the two ankle portions, and the heel portion are integrally formed of at least one common material;

(b) a toe cap joined to the monocoque skate boot body proximate the toe end thereof, the toe cap being formed of a material which is dissimilar to the common material of the monocoque skate boot body, the toe cap comprising: (i) an upright end wall supported to extend upwardly from the bottom of the boot body at the toe end of the sole portion, (ii) two upright side walls supported to extend upwardly from the bottom of the boot body at said laterally opposing sides of the sole portion respectively, and (iii) an upper portion joined between the end wall and the side walls at a location spaced above the toe end of the sole portion so as to define a toe box between the upper portion of the toe cap and the toe end of the sole portion for receiving toes of the foot of the user therein; and (c) a tongue supported to span the tongue opening between the upper free edges of the side wall portions;

wherein the of the monocoque skate boot body terminates at a top edge which is spaced below an upper boundary of the toe box defined by the upper portion of the toe cap such that the toe box is covered from above by the toe cap but remains uncovered from above by the monocoque skate boot body.

2. The skate boot according to claim 1 wherein the monocoque skate boot body further comprises a lower toe portion extending upwardly from the toe end of the sole portion to define the top end of the monocoque skate boot body at the toe end that is spaced below the upper boundary of the toe box, in which the lower toe portion is overlapped at an outer side by at least one of the end wall and the two side walls of the toe cap.

3. The skate boot according to claim 1 wherein the toe cap includes a lower flange extending inwardly from a bottom end of at least one of the end wall and the two side walls of the toe cap in overlapping configuration along the bottom of the monocoque skate boot body at the toe end of the sole portion.

4. The skate boot according to claim 3 wherein the lower flange extends inwardly from each of the end wall and the two side walls to an inner edge which is generally U-shaped.

5. The skate boot according to claim 3 in combination with a lower mounting frame below the sole portion in fastened connection to the sole portion using at least one mechanical fastener extending between the lower mounting frame and the monocoque skate boot body through the lower flange of the toe cap.

6. The skate boot according to claim 1 wherein the inner and outer side wall portions of the boot body terminate at respective upright forward edges which are spaced inwardly from the toe end of the sole portion and wherein the side walls of the toe cap overlap an outer side of the inner and outer side wall portions proximate respective rear edges thereof.

7. The skate boot according to claim 1 wherein at least one side wall of the toe cap includes at least one eyelet opening therein which receives an eyelet which mechanically fastens the eyelet opening to a corresponding opening in the respective side wall portion of the boot body in alignment therewith.

8. The skate boot according to claim 1 wherein the tongue is joined to the upper portion of the toe cap.

9. The skate boot according to claim 8 wherein the tongue is longitudinally adjustable relative to the toe cap.

10. The skate boot according to claim 1 wherein the side walls of the toe cap each comprises a rear edge and a stepped flange along the rear edge in which the side wall is reduced in thickness relative to a remainder of the side wall, and wherein the skate boot further comprises an outer panel bonded to an outer side of each side wall portion of the boot body and having a forward edge portion in overlapping configuration with a respective one of the stepped flanges of the side walls of the toe cap to which the forward edge portion is joined by stitching.

11. The skate boot according to claim 1 wherein the material of the toe cap is more resilient than the common material of the boot body.

12. The skate boot according to claim 1 wherein the monocoque skate boot body further comprises: (v) a lower Achilles tendon portion above the heel portion for receiving a base of an Achilles tendon of the foot of the user, and (vi) an upper Achilles tendon portion above the lower Achilles tendon portion comprising an upright supporting flange; and wherein the skate boot further comprises a tendon guard including a lower mounting portion for mounting on the upright supporting flange of the upper Achilles tendon portion of the skate boot body and an upper guard portion extending upwardly above the lower mounting portion, the lower mounting portion including an inner mounting flange for extending downwardly along an inner surface of the upright supporting flange of the upper Achilles tendon portion and an outer mounting flange spaced apart from the inner mounting flange for receiving the upper supporting flange of the upper Achilles tendon portion therein such that the outer mounting flange extends downwardly along an outer surface of the upright supporting flange of the upper Achilles tendon portion.

13. The skate boot according to claim 1 in combination with a lower mounting frame below the sole portion in fastened connection to the sole portion using a plurality of mechanical fasteners, wherein the skate boot further comprises an anchor body supported on the sole portion such that at least a lower portion of the sole portion of the skate boot body is clamped between the anchor body and the lower mounting frame by at least some of the plurality of mechanical fasteners extending through said lower portion of the sole portion, the anchor body being formed of a material which is dissimilar to the skate boot body.

14. A skate boot for receiving a foot of a user, the skate boot comprising:

a sole portion extending longitudinally between a toe end and a heel end for supporting the foot of the user thereon;

two ankle portions extending upwardly from laterally opposing sides of the sole portion for spanning over respective ankles of the foot of the user;

a heel portion extending upwardly from the heel end of the sole portion in connection between the two ankle portions for receiving a heel of the user;

a lower Achilles tendon portion above the heel portion for receiving a base of an Achilles tendon of the foot of the user;

an upper Achilles tendon portion above the lower Achilles tendon portion comprising an upright supporting flange; and a tendon guard comprising:

a lower mounting portion for mounting on the upright supporting flange of the upper Achilles tendon portion of the skate boot body; and an upper guard portion extending upwardly above the lower mounting portion;

the lower mounting portion including an inner mounting flange for extending downwardly along an inner surface of the upright supporting flange of the upper Achilles tendon portion and an outer mounting flange spaced apart from the inner mounting flange to define a slot between the inner and outer mounting flanges receiving the upright supporting flange of the upper Achilles tendon portion therein such that the outer mounting flange extends downwardly along an outer surface of the upright supporting flange of the upper Achilles tendon portion.

15. The skate boot according to claim 14 further comprising a liner member spanning an inner side of the heel portion, wherein a bottom edge of the inner mounting flange of the tendon guard abuts an upper edge of the liner member and wherein a thickness of the inner mounting flange of the tendon guard proximate the bottom edge thereof is less than a thickness of the liner member proximate the upper edge thereof.

16. The skate boot according to claim 14 further comprising a joining fastener extending collectively through the inner mounting flange of the tendon guard, the outer mounting flange of the tendon guard, and the upright supporting flange of the upper Achilles tendon portion of the skate boot.

17. The skate boot according to claim 14 wherein the upper guard portion is wider than the lower mounting portion.

18. The skate boot according to claim 14 wherein the upright supporting flange of the upper Achilles tendon portion terminates at an upper edge which is recessed in height relative to the two ankle portions of the skate boot.

19. A skate boot for receiving a foot of a user in combination with a lower mounting frame in fastened connection below the skate boot using a plurality of mechanical fasteners, the skate boot comprising:

a monocoque skate boot body comprising: (i) a sole portion extending longitudinally between a toe end and a heel end for supporting the foot of the user thereon, (ii) two ankle portions extending upwardly from laterally opposing sides of the sole portion for spanning over respective ankles of the foot of the user, and (iii) a heel portion extending upwardly from the heel end of the sole portion in connection between the two ankle portions, wherein the sole portion, the two ankle portions, and the heel portion are integrally formed of a fiber and resin composite material;

an anchor body supported on the sole portion such that at least a lower portion of the sole portion of the monocoque skate boot body is clamped between the anchor body thereabove and the lower mounting frame therebelow by at least some of the plurality of mechanical fasteners extending through said lower portion of the sole portion between the anchor body and the lower mounting frame;

the anchor body being formed of a plastic material which is dissimilar to the skate boot body; and an insole received within the skate boot body above the anchor body.

* * * * *